US006142354A

United States Patent [19]

Boss et al.

[11] Patent Number: 6,142,354

[45] Date of Patent: Nov. 7, 2000

[54] GATHERING AND STITCHING MACHINE HAVING VARIABLE PITCH AND A DRIVE DEVICE THEREFOR

[75] Inventors: Heinz Boss, Strengelbach; Beat von Aesch, Schönenwerd, both of Switzerland

[73] Assignee: Grapha-Holding AG, Hergiswil, Switzerland

[21] Appl. No.: 09/312,849

[22] Filed: May 17, 1999

[30] Foreign Application Priority Data

May 15, 1998 [EP] European Pat. Off. ..... 98810450

[51] Int. Cl.[7] ..... B42B 2/00

[52] U.S. Cl. ..... 227/100; 227/44; 227/81; 227/82; 270/52.16; 270/52.18

[58] Field of Search ..... 227/44, 79, 81, 227/52, 78, 83, 84, 88, 89, 100; 270/52.16, 52.18, 52.26, 82.28, 52.29

[56] References Cited

U.S. PATENT DOCUMENTS

| | | | |
|---|---|---|---|
| 4,614,290 | 9/1986 | Boss | 227/100 |
| 4,735,406 | 4/1988 | Weber | 270/52.18 |
| 5,120,036 | 6/1992 | Simons | 270/52.18 |
| 5,172,897 | 12/1992 | Hansch et al. | 270/52.18 |
| 5,356,125 | 10/1994 | Hansch et al. | 227/81 |
| 5,417,410 | 5/1995 | Meier | 270/52.18 |
| 5,667,212 | 9/1997 | Merkli | 270/52.16 |

FOREIGN PATENT DOCUMENTS 662 987 11/1987 Switzerland .

*Primary Examiner*—Scott A. Smith
*Attorney, Agent, or Firm*—Venable; Robert Kinberg

[57] ABSTRACT

A gathering and stapling machine includes a gathering chain for conveying printed products and having a variable chain pitch. A stapling device staples the printed products that are conveyed on the gathering chain. A drive device includes a first gear for driving the stapling device, a second gear for driving the gathering chain and a change-over device connected to the first and second gears and having at least two fixed turns ratios.

20 Claims, 3 Drawing Sheets

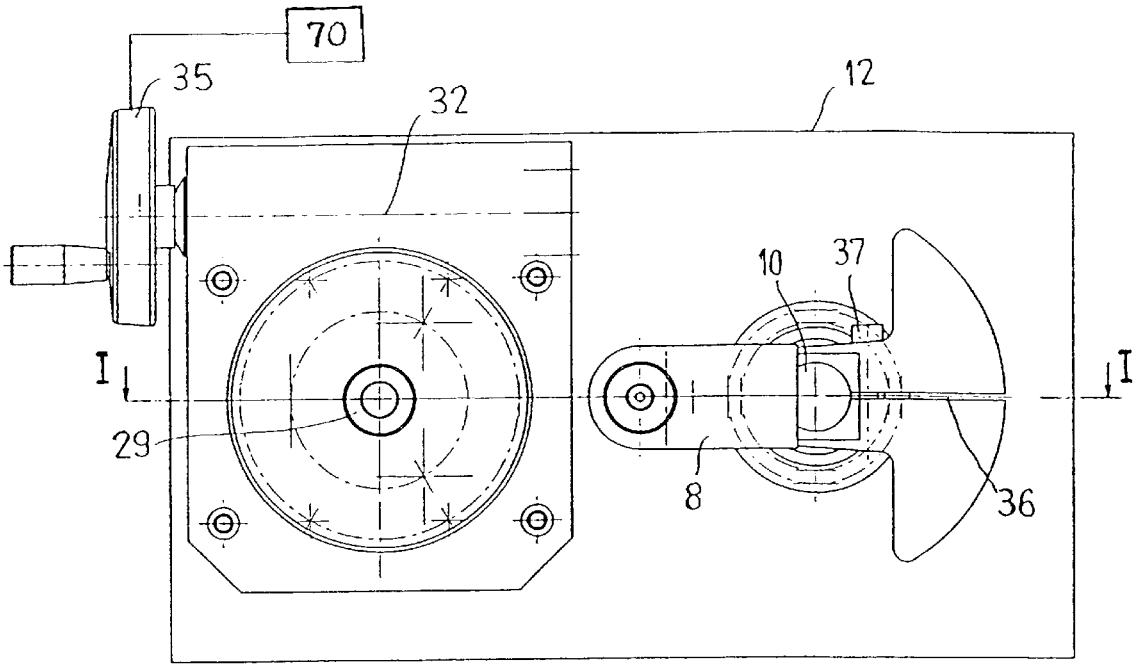
Fig. 3
Fig. 1
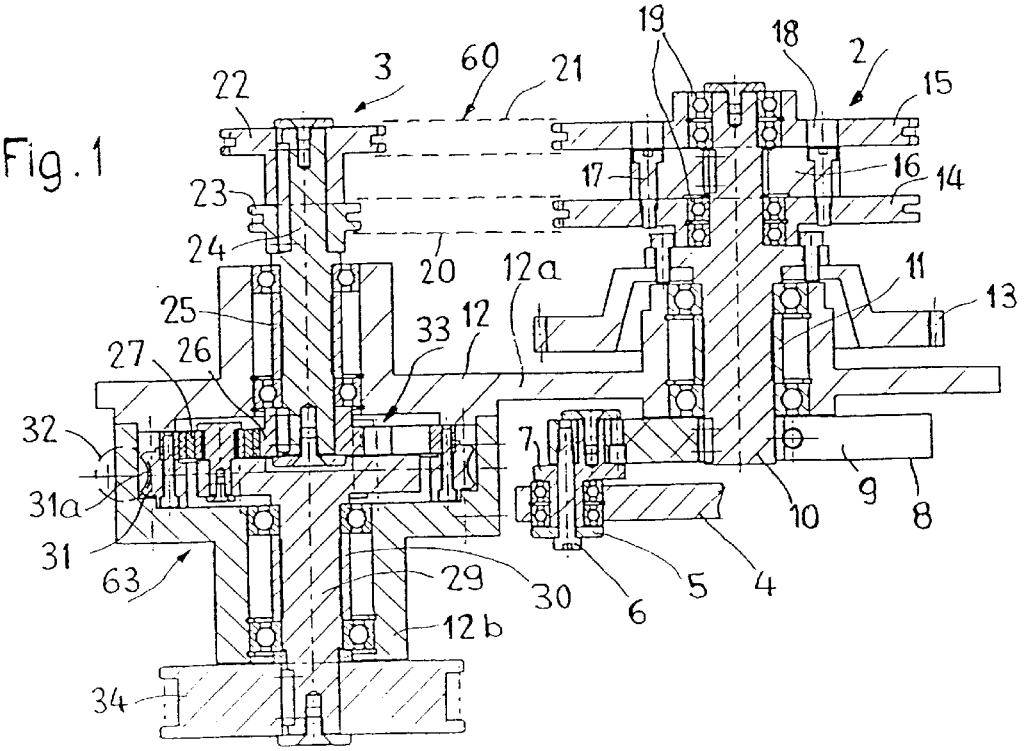

GATHERING AND STITCHING MACHINE HAVING VARIABLE PITCH AND A DRIVE DEVICE THEREFOR

CROSS-REFERENCE TO RELATED APPLICATIONS

Priority is claimed with respect to European Application No. 98810450.1-2304, filed in the European Patent Office on May 15, 1998, the disclosure of which is incorporated herein by reference.

BACKGROUND OF THE INVENTION

The invention relates to a gathering and stapling (stitching) machine that includes a gathering chain for conveying printed products and having a variable chain pitch, with a stapling device for stapling the printed products that are conveyed on the gathering chain.

The Applicant's Swiss patent publication CH-A-662 987 discloses a saddle stitcher having a drive device of this type. In this saddle stitcher, the stapling machine can be converted to a different saddle-chain pitch in that the step-down ratio of an advancing gear of the drive device is correspondingly changed, and the stroke path of the stapling carriage is adapted to the other chain pitch through an adjustment of a ball-headed spindle. The step-down ratio is changed corresponding to the selected chain pitch through the exchange of advance wheels. A conversion of the gathering-chain pitch permits an increase in the machine output. If, for example, the book bindery faces the task of stapling a large quantity of small printed products, it is worthwhile to select a correspondingly-small pitch of the conveyor device and adapt the machine accordingly. It is therefore known to alter the pitch of the conveyor device corresponding to the size of the printed products while maintaining the device's speed. Altering the pitch of the aforementioned saddle stitcher is, however, very time-consuming, and therefore does not occur often for smaller jobs. Furthermore, the conversion work requires appropriately-trained personnel.

SUMMARY OF THE INVENTION

It is an object of the invention to provide a drive device for a gathering and stapling machine that permits a simple conversion to a different gathering-chain pitch.

The above and other objects are accomplished according to the invention by the provision of a gathering and stapling machine, including: a gathering chain for conveying printed products and having a variable chain pitch; a stapling device for stapling the printed products that are conveyed on the gathering chain; and a drive device including a first gear for driving the stapling device, a second gear for driving the gathering chain; and a change-over device connected to the first and second gears and having at least two fixed turns ratios.

Thus, in the drive device of the invention, the change-over device adapts the turns ratio between the drive for the stapling carriage and the drive for the gathering chain, depending on the chain pitch. The change-over device has at least two fixed turns ratios. The two turns ratios are selected such that, for example, the gathering chain is driven over a 15 or 21 inch pitch. A change-over device of this type permits a very simple and fast changeover between two turns ratios without necessitating an exchange of pinions, unlike in the prior art.

It is especially easy to adapt the turns ratio if the change-over device has a chain-wheel change-over. To convert the drive, a transition is made from one chain pitch to the other. This process can be completed in a few minutes. The technical requirements for such an operation are significantly lower than before.

In accordance with a modification of the invention, the second gear has a conversion gear, preferably a planetary gear. If the planetary gear has a gear ring with an inner toothing that can be rotated by means of a worm gear pair, the drive wheel for the gathering chain can be rotated forward and backward while running. The gathering chain can thus be displaced while running. This permits an exact orientation of the gathering chain with respect to the removal point at the end station. It is likewise possible to make a correction while the gathering and stapling machine is running.

With the drive device of the invention, the chain pitch can be converted in three simple steps. In a first step, the stroke of the stapling carriage is adapted. In a second step, the aforementioned change-over device adapts the drive to the chain pitch and, in a third step, the planetary gear sets the gathering chain in motion and corrects it, if necessary.

A change-over device having two chains that can be selectively connected to a carrier is particularly structurally simple and robust. In an advantageous modification, the selective connection is produced with, for example, removable screws or a switchable coupling.

Further advantageous features and advantages will become apparent from the following detailed description considered in conjunction with the accompanying drawings.

BRIEF DESCRIPTION OF THE DRAWINGS

FIG. 1 is a section through a drive device of the invention along the line I—I of FIG. 3.

FIG. 3 is side elevation of the drive device shown in FIG. 2.

DETAILED DESCRIPTION OF THE INVENTION

Referring to FIG. 1, there is shown a drive device according to the invention which includes a first gear 2 and a second gear 3, both being seated in a housing 12.

Figure 2:
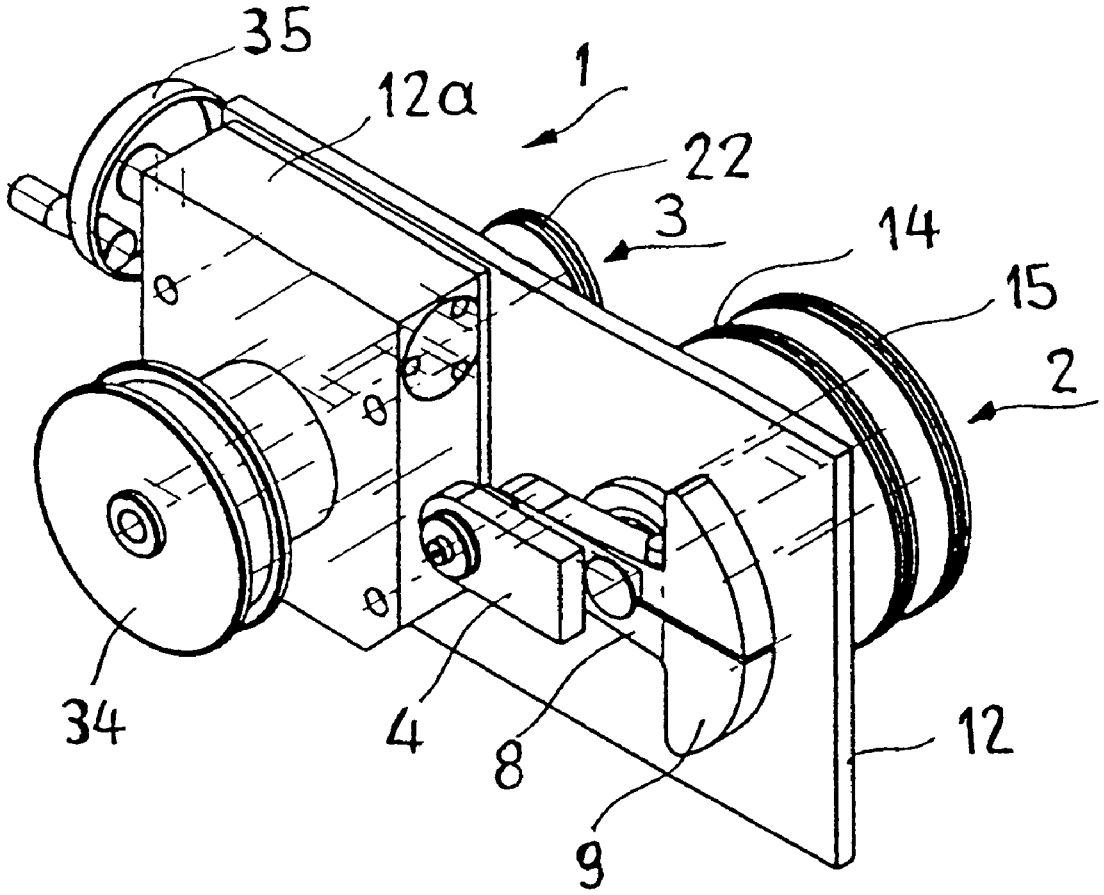
FIG. 2 is a perspective view of the drive device of the invention.
Figure 4:
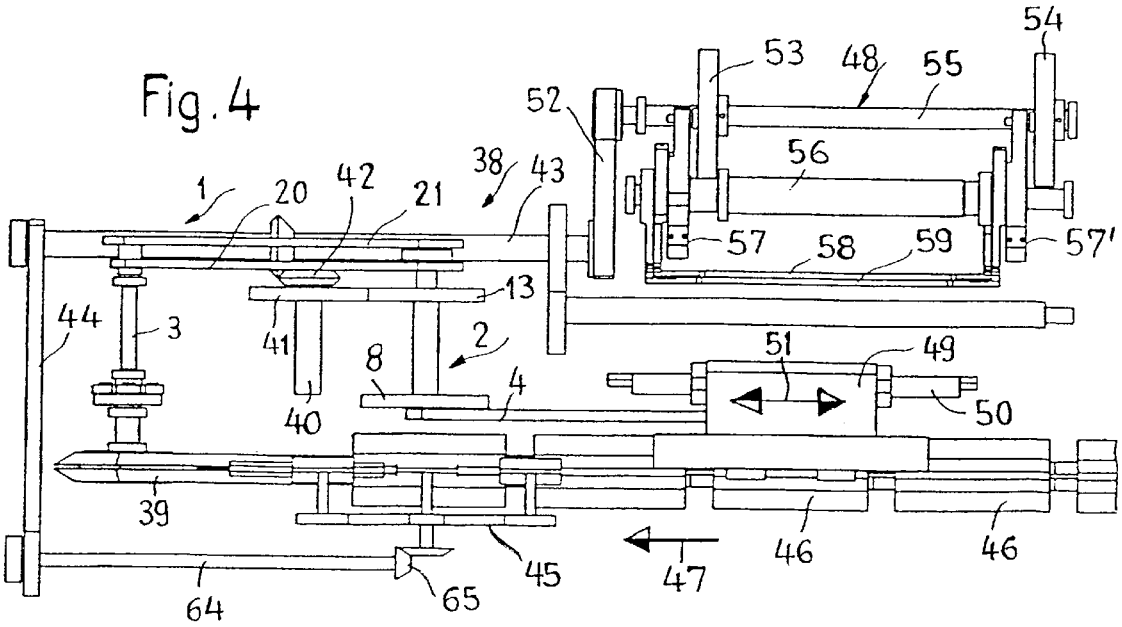
FIG. 4 is a schematic, plan view of a gathering and stapling machine having a drive device according to the invention.

Referring additionally to FIG. 4, first gear 2 includes a wheel 13 fixedly connected to a shaft 10 and connected via a gear 41 to a main drive shaft 40. Also connected to shaft 10 is a crank 8, which, according to FIG. 2, has a counterweight 9 and is connected by a journal 7 to a connecting rod 4 hinged at its opposite end to stapling carriage 49 of a stapling device 48 as shown in FIG. 4. Journal 7 is rotatable relative to rod 4 via a bearing 5. When shaft 10 rotates, stapling carriage 49 is moved back and forth, in the directions of double-headed arrow 51, on a guide rod 50. The stroke of carriage 49 can be adjusted in that journal 7 is adjusted through the relocation of a pin 6 such that the spacing between the axis of rotation of bearing 5 and the axis of shaft 10 is changed. This type of conversion can be performed quickly and simply. A critical point is that first gear 2 only performs the stroke of carriage 49.

FIG. 4 shows sliding members 58 and 59, known per se, for the shaping elements and the punches, being driven by main drive shaft 40 via beveled gear arrangement 42 and a shaft 43 together with a drive element 52. Cam wheels 53 and 54 are secured to a shaft 55 for moving sliding members 58 and 59. These wheels cooperate, respectively, with levers 57 and 57', which are disposed on a further shaft 56 and engage the sliding members 58 and 59, respectively. The separation of the drive for stapling carriage 49 from the drive for the sliding members 58 and 59 significantly simplifies the conversion process.

First gear 2 is connected to second gear 3 by a change-over device 60. This change-over device 60 has two endless, parallel chains 20 and 21, one of which is always inactive and co-rotates with the other. Chain 20 runs on a chain wheel 14 of first gear 2 and on a significantly smaller chain wheel 23 of second gear 3. Chain wheel 14 is rotatably connected to shaft 10 by a ball bearing 19. Second chain 21 runs on a chain wheel 15 and a significantly smaller chain wheel 22 of second gear 3. Chain wheel 15 is likewise seated with a ball bearing on shaft 10. As is apparent, chain wheels 14 and 15 are—albeit not necessarily—embodied with the same number of teeth, and chain wheels 22 and 23 have different numbers of teeth. The turns ratios of chain wheels 15, 22 and 14, 23, in combination with the turns ratio in planetary gear 33 and the number of teeth of a chain wheel 34 and the selected chain pitch, allow stapling carriage 49 to run synchronously with the gathering chain 39 (FIG. 4) over a certain path. Of the two chain wheels 14 and 15, one or the other is selectively connected fixedly to shaft 10. To this end, a carrier 16 disposed between the two chain wheels 14 and 15 is fixedly wedged to shaft 10. Carrier 16 receives a plurality of fastening screws 17, which, depending on their position, connect either chain wheel 14 or chain wheel 15 to carrier 16 and shaft 10, for safeguarding against relative rotation. In FIG. 1, fastening screws 17 connect the carrier 16 to chain wheel 14.

Bores 18 are provided in chain wheel 15 for operating fastening screws 17. For connecting chain wheel 15 to carrier 16, the screws are screwed to carrier 16 through offset bores in chain wheel 15, not shown. Fastening screws 17 and chain wheel 14 are simultaneously disengaged. Following such a conversion, chain 20 is secured with screws and chain 21 transmits the rotation of shaft 10 to a shaft 24 of second gear 3. As is evident, a conversion of this nature is very simple, and can be performed in a few minutes with a suitable screwdriver. The two chain wheels 22 and 23 are specified for fixed pitches. The turns ratio between chain wheels 15 and 22 is specified, for example, for a chain pitch of 14 inches, and the turns ratio between chain wheels 14 and 23 is specified for a chain pitch of 21 inches. Preferably only two preset and fixed pitches are provided. It is conceivable, however, to provide more than two chain sets.

Second gear 3 includes a conversion gear, preferably a planetary gear. This gear includes a sun wheel 26 that is secured to shaft 24, which is rotatably seated with a bearing 25 in housing 12. Sun wheel 26 preferably meshes with three planet wheels 27, which are fixedly connected to a drive shaft 29. Planet wheels 27 engage an inner toothing of a gear ring 31 which additionally has an outer toothing 31*a*. This outer toothing 31*a* engages a worm 32 that can be rotated with the hand wheel 35 shown in FIGS. 2 and 3 The rotation of gear ring 31 effects the rotation of chain wheel 34 in one or the other direction via drive shaft 29. Alternatively, the rotation of chain wheel 34 may be automatically adjusted with the use of a computer control 70. Chain wheel 34 engages gathering chain 39 shown in FIGS. 4 and 5. Gathering chain 39 conveys printed product in the direction of arrow 47 shown in FIG. 4. First gear 2 thus lies upstream of second gear 2 relative to the direction of conveyance of chain 39. Chain 39 is a double gathering chain, known per se, and has carriers 61 that can be rearranged at regular intervals. The spacing between adjacent carriers 61 corresponds to the pitch of the gathering chain 39. Through the rotation of a hand wheel 35, the drive 34, and thus the gathering chain 39 can be displaced in its longitudinal direction while running. It is therefore possible to orient the carriers 61 of a gathering chain 39 exactly to the grippers of the end station 45, depending on the format, to the center of a product 46.

According to FIG. 1, planetary gear 33 is seated in a gear case 63 formed by two close-fitting housing parts 12*a* and 12*b*. Housing part 12*b* also receives a bearing 30 for drive shaft 29. Connecting rod 4 lies outside of the case formed by the two housing parts 12*a* and 12*b*. A significant advantage of this arrangement is that the oil loss over connecting rod 4, which has been commonplace up to now, is avoided. Another important point is that drive device 1 requires only one planetary gear 33. As is apparent, drive device 1 is distinguished by a simple, compact, modular design. The conversion gear is not required; an embodiment that does not include a conversion gear is also conceivable.

Figure 5:
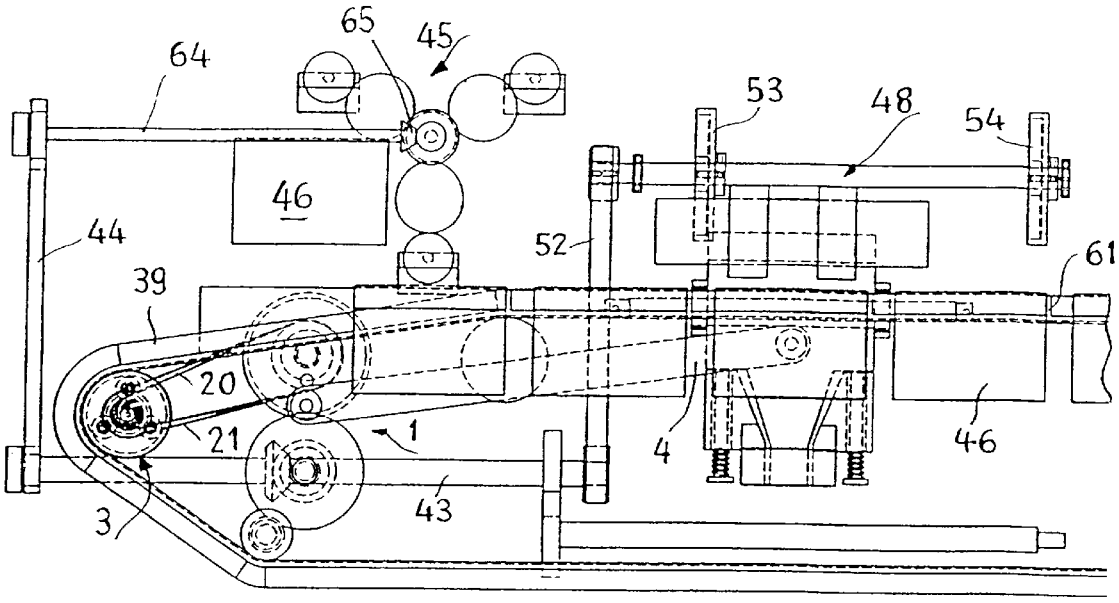
FIG. 5 is a further schematic view of the gathering and stapling machine having the drive device of the invention.

According to FIGS. 4 and 5, stapled products 46 are raised from gathering chain 39 by an extraction device 45, only indicated schematically, and transferred to a further processing device, not shown. Extraction devices 45 are known in various embodiments, and are familiar to a person skilled in the art. The drive of extraction device 45 is likewise initiated by a shaft 43, which is connected via an endless drive element 44 to a further shaft 64, and via an angular gear 65 to extraction device 45.

The invention has been described in detail with respect to referred embodiments, and it will now be apparent from the foregoing to those skilled in the art, the changes and modifications may be made without departing from the invention in its broader aspects, and the invention, therefore, as defined in the appended claims, is intended to cover all such changes and modifications as to fall within the true spirit of the invention.

What is claimed is:

1. A gathering and stapling machine, comprising:

a gathering chain for conveying printed products and having a variable chain pitch;

a stapling device for stapling the printed products that are conveyed on the gathering chain; and a drive device including a first gear for driving the stapling device, a second gear for driving the gathering chain, and a change-over device connected to the first and second gears and having at least two fixed turns ratios.

2. The machine according to claim 1, wherein the change-over device includes two exchangeable chains and means for selecting one or the other to be inactive.

3. The machine according to claim 2, wherein stapling device includes a carriage and the drive device includes a connecting rod connected to the carriage and an adjustable journal connecting the first gear to the connecting rod for driving the carriage.

4. The machine according to claim 3, wherein the drive device includes a drive shaft, the first gear includes drive wheels rotatably seated on the drive shaft, and the drive device further includes means for selectively connecting one of the drive wheels to the drive shaft.

5. The machine according to claim 4, wherein the drive device includes a hub fixedly seated on the drive shaft and fastening means for selectively connecting the selected one of the drive wheels to the hub.

6. The machine according to claim 5, wherein the drive wheels of the first gear comprise two chain wheels seated with ball bearings on the drive shaft.

7. The machine according to claim 6, wherein the second gear comprises a conversion gear.

8. The machine according to claim 7, wherein the conversion gear comprises a planetary gear.

9. The machine according to claim 8, wherein the drive device includes a further drive wheel for the gathering chain and a gear ring having an inner toothing engaging the planetary gear and an outer toothing for being rotated by a worm for rotating the further drive wheel backward and forward while the gathering chain runs.

10. The machine according to claim 3, and further including a common housing in which the first and second gears are seated.

11. The machine according to claim 10, wherein the housing includes a gear case, and the connecting rod is disposed outside of the gear case.

12. The machine according to claim 9, wherein the first gear is upstream of the second gear with respect to a direction of conveyance of the printed products on the gathering chain.

13. The machine according to claim 1, further comprising first and second drive elements for connecting the first and second gears to one another, and means for selecting one or the other of the drove elements to be inactive.

14. The machine according to claim 13, wherein the two drive elements are arranged to connect the first and second gears so that one drive element operates the gathering chain with a preset, first pitch, and the other drive element operates the gathering chain with a preset, second pitch.

15. The machine according to claim 14, wherein the first pitch is 21 inches and the second pitch is 25 inches.

16. The machine according to claim 13, and further including a drive wheel for the gathering chain and an adjusting means for the second gear with which the drive wheel for the gathering chain can be rotated forward and backward.

17. The machine according to claim 16, wherein the adjusting means includes a hand wheel for manual adjustment.

18. The machine according to claim 17, wherein the adjusting means is connectable to a computer for automatic adjustment.

19. The machine according to claim 1, wherein the drive device includes a wheel disposed at the first gear and being connectable to a main drive of the gathering chain.

20. The machine according to claim 1, wherein the first and second gears comprise a modular unit.

* * * * *